US007350273B1

(12) United States Patent
Skipper

(10) Patent No.: US 7,350,273 B1
(45) Date of Patent: Apr. 1, 2008

(54) VEHICLE BODY HINGE

(75) Inventor: Bruce Skipper, Mohnton, PA (US)

(73) Assignee: Reading Truck Body, Inc., Shillington, PA (US)

( * ) Notice: Subject to any disclaimer, the term of this patent is extended or adjusted under 35 U.S.C. 154(b) by 0 days.

(21) Appl. No.: 11/246,316

(22) Filed: Oct. 7, 2005

(51) Int. Cl.
*E05D 3/06* (2006.01)

(52) U.S. Cl. ..... 16/366; 16/369

(58) Field of Classification Search ..... 16/366, 16/336, 368, 369, 370, 50, 54, 288; 49/397, 49/398

See application file for complete search history.

(56) References Cited

U.S. PATENT DOCUMENTS

| | | | | | |
|---|---|---|---|---|---|
| 2,013,915 | A * | 9/1935 | Hughes | 16/369 |
| 2,120,685 | A * | 6/1938 | Soss et al. | 16/288 |
| 2,686,332 | A * | 8/1954 | Moon et al. | 16/369 |
| 3,363,281 | A | 1/1968 | Borsani | |
| 3,673,635 | A * | 7/1972 | Cencioni | 16/358 |
| 4,236,274 | A * | 12/1980 | Omote et al. | 16/225 |
| 4,817,241 | A * | 4/1989 | Koch et al. | 16/238 |
| 4,971,382 | A | 11/1990 | Ohno | |
| 5,475,897 | A | 12/1995 | Satoh et al. | |
| 6,099,070 | A * | 8/2000 | Yocum | 296/182.1 |
| 6,139,081 | A * | 10/2000 | Lemieux | 296/37.7 |
| 6,141,832 | A * | 11/2000 | Salice | 16/366 |
| 6,786,532 | B2 | 9/2004 | McNally | |
| 2005/0188505 | A1 | 9/2005 | Bennett | |

FOREIGN PATENT DOCUMENTS

| | | | |
|---|---|---|---|
| GB | 2203483 | A * | 10/1988 |
| JP | 09279927 | A * | 10/1997 |

OTHER PUBLICATIONS www.cabinetparts.com/shop_2003/euro_hinges/blum/blum_hinges.php?SID=11264. 5 pp. printed Sep. 11, 2005.

* cited by examiner

*Primary Examiner*—Chuck Y. Mah
(74) *Attorney, Agent, or Firm*—Pepper Hamilton LLP

(57) ABSTRACT

A hinge, such as a truck body door hinge, includes a first mounting member, a second mounting member, a first connecting member that is pivotably connected to the first and second mounting members, and a second connecting member that is also pivotably connected to the first and second mounting members. The first and second connecting members are pivotally connected to each other at an axial position.

15 Claims, 7 Drawing Sheets

PRIOR ART

VEHICLE BODY HINGE

BACKGROUND

1. Technical Field

The disclosure contained herein relates to vehicle body hinges and vehicle bodies having hinged compartments.

2. Description of the Related Art

Most vehicles, including cars, trucks, vans and other vehicles, include enclosures with openings that are covered by one or more doors. The doors may be pivotably opened and closed on a hinge that mounts the door to the vehicle body.

For example, referring to FIG. 1, a truck 12 may have a body 14 that contains one or more doors 16, 18 and 20. Each door may contain a handle, recess or other means 17, 19 and 21 by which a person may grasp the door and swing it open. As illustrated in FIG. 1, doors may open in various directions. For example, door 16 contains a handle 17 that is located on the right side of the door, suggesting that the door swings open along a hinge positioned at the left side of the door when viewed from the perspective of FIG. 1. Similarly, door 18 has a handle 19 located at an upper area of the door, suggesting that the door swings downward around a hinge positioned at the bottom of the door. Door 20 has a handle 21 located to the left of the door, indicating that the door swings open along the hinge positioned at the right side of the door.

Currently, there are three primary types of hinges used to mount truck body access doors and other vehicle doors to a truck or a vehicle body. One type is a surface mount hinge that is mounted on the exterior of the vehicle body. Such a hinge includes a bracket that connects to the body exterior, a bracket that the connects to the door exterior, and an interlocking member that is secured by a hinge pin or rod. The rod spins within the interlocking members, or the interlocking members move around the rod, as the door is opened and closed. Surface mount hinges are prone to rust and damage, as they are exposed to the elements and sources of impact. In addition, they are often aesthetically undesirable, as they break up what may otherwise be a smooth vehicle surface body.

A second style of body hinge is known as a piano-type hinge. A piano-type hinge is similar to a surface mount hinge, except that it is mounted on the inside of the truck body and the inside of the door. However, the interlocking members and hinge pin of a piano-type hinge protrude from the door/opening interface. Thus, a piano-type hinge is also exposed to elements and impact sources.

A third style of hinge overcomes the problem of exposing the hinge to the elements and impact sources by being mounted inside the body and attached to the interior of the door in a "car door style" or "wrecker style" arrangement. Although car door style hinges are mounted inside the body, they significantly reduce storage compartment space and accessibility, as they require that a recess be built into the body to accept a portion of the door as it is opened. Such hinges also require a large seal and mounting area to be located around the door frame, and they thus limit accessibility to the vehicle compartment.

Therefore, a need exists for an improved hinge assembly for doors on truck bodies and other vehicles. The embodiments described below are directed to solving one or more of the problems described above.

SUMMARY

In accordance with one embodiment, a vehicle body door hinge, includes: (i) a first mounting member having a first axial member and a second axial member; (ii) a second mounting member having a third axial member and a fourth axial member; (iii) a first connecting member that is pivotably connected to the first axial member and the third axial member; and (iv) a second connecting member that is pivotably connected to the second axial member and the fourth axial member. The first connecting member and the second connecting member are pivotally connected at an axial position.

The first mounting member may include a planar surface so that the first axial member and second axial member protude from the planar surface. Optionally, each connecting member may include a radial member and an extension member that are interconnected at an axial position. In addition, each connecting member may include a pair of radial members joined by an interconnecting member and a pair of extension members, such that each extension member is joined to a radial member at an axial position.

Optionally, each mounting member includes one or more openings that are adapted to be received by a hinge pan. Each mounting member may be pivotably connected to a connecting member by a pin. Also optionally, wherein the hinge may have a working load bearing rating of at least 90 pounds and does not require an attached spring for operation.

In another embodiment, a truck body door hinge includes a first mounting member having a first axial member and a second axial member, wherein the first mounting member comprises a first planar surface and the first axial member and second axial member protude from the second planar surface. A second mounting member may have a third axial member and a fourth axial member, wherein the second mounting member comprises a second planar surface and the third axial member and fourth axial member protude from the second planar surface a first connecting member that is pivotably connected to the first axial member and the third axial member. A second connecting member may be pivotably connected to the second axial member and the fourth axial member, and the first connecting member and the second connecting member may be pivotally connected at an axial position.

In another embodiment, a truck body has a storage compartment with an opening. A door is sized to cover the opening. The door and the storage compartment each include a hinge pan sized and positioned to accept a hinge. The hinge includes a first mounting member attached to the door, and is has a first axial member and a second axial member. A second mounting member is attached to the storage compartment and has a third axial member and a fourth axial member. A first connecting member may be pivotably connected to the first axial member and the third axial member. A second connecting member may be pivotably connected to the second axial member and the fourth axial member. The first connecting member and the second connecting member may be pivotally connected at an axial position. The door may be sized to be larger than the opening, so that the hinge lifts and rotates the door away from the storage compartment when the door is opened.

DETAILED DESCRIPTION

As used herein and in the appended claims, the singular forms "a", an and "the" include the plural reference unless the context clearly dictates otherwise. Unless defined otherwise, all technical and scientific terms used herein have the same meanings as commonly understood by one of ordinary skill in the art.

Figure 1:
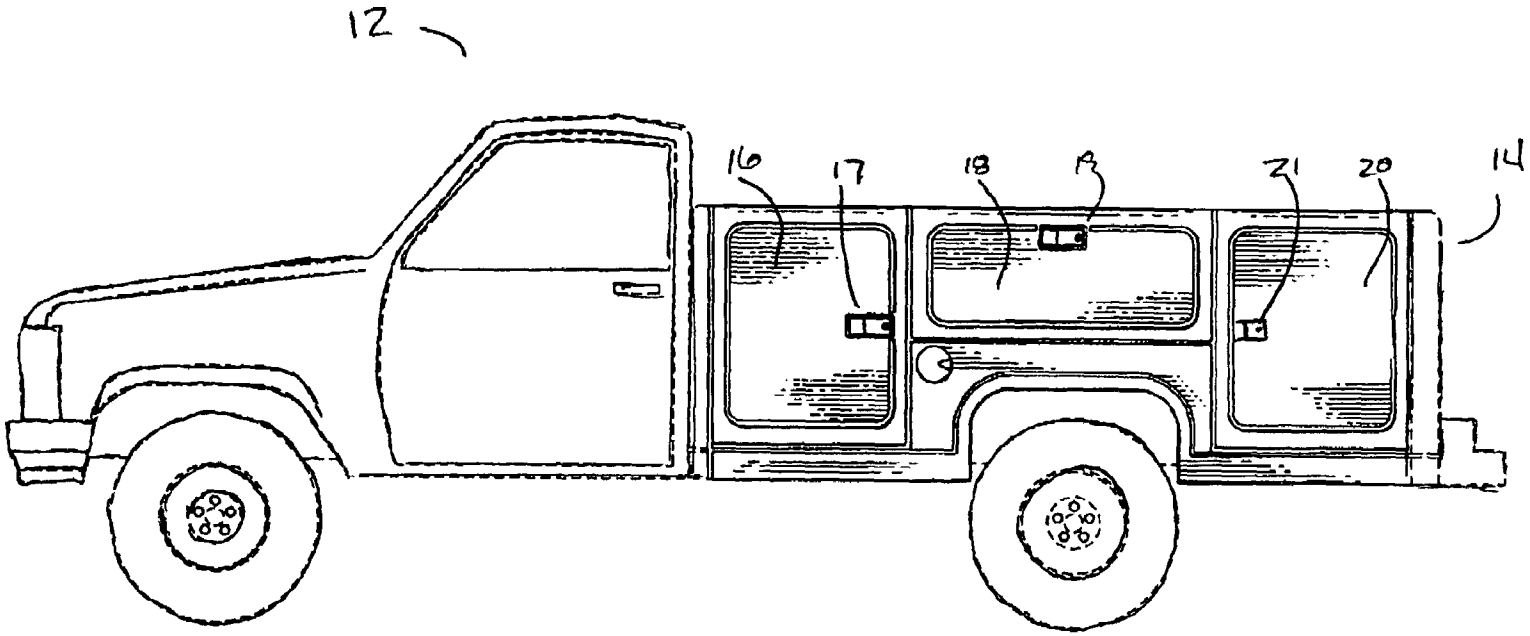
FIG. 1 is an illustration of an exemplary truck body.
Figure 2:
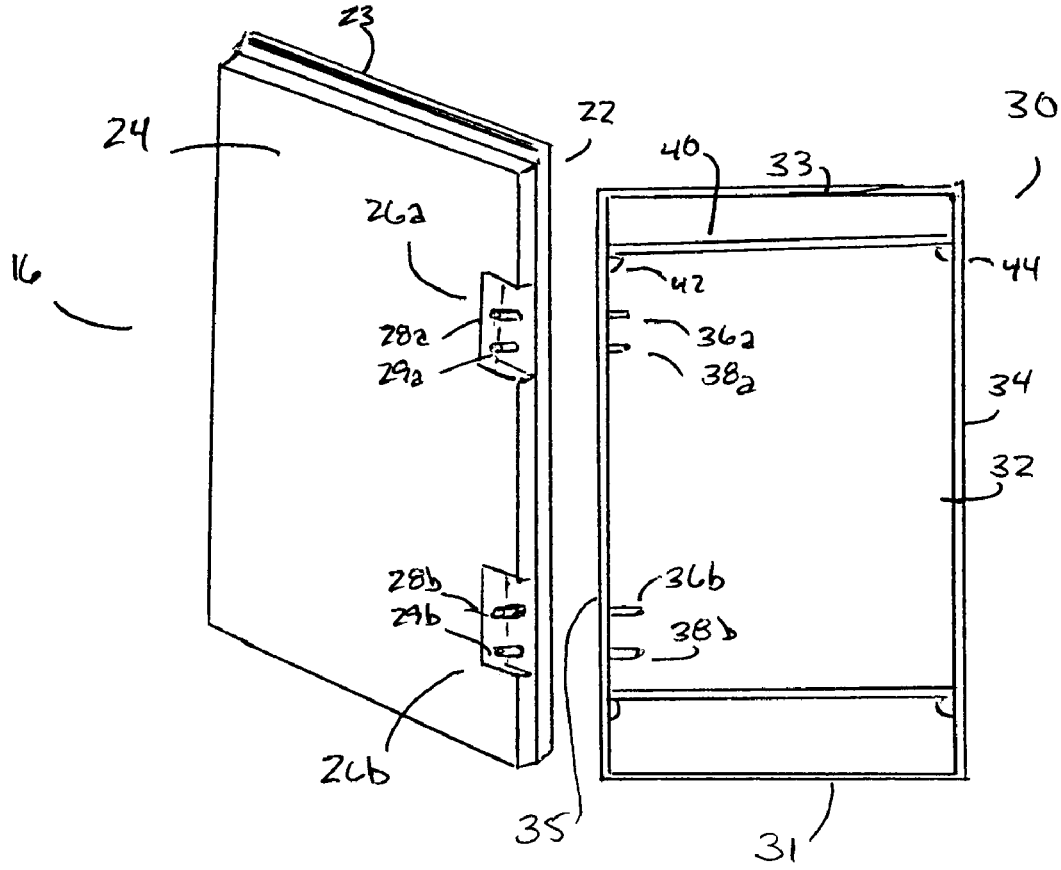
FIG. 2 is an illustration of an exemplary door and storage compartment.

Referring to FIG. 2, an exemplary vehicle body storage compartment 30 and door 16 are illustrated. The compartment 30 includes an opening 32 that is defined by a plurality of walls 34. Compartment 30 may be a truck or van storage compartment, as illustrated in FIG. 2 with exemplary storage shelves 40 and shelf mounting brackets 42 and 44, or it may be any other vehicle compartment. In addition, access area 32 may be defined by walls 31, 33, 34, 35. Alternatively, access area 32 may be defined by a frame which leads to a larger storage compartment.

Door 16 includes an outer layer 22 and an optional inner layer 24. The space between inner layer 24 may be solid or hollow depending on the desired strength of the door. One or more hinge mounting pans 26*a* and 26*b*, which are areas on which a hinge may be mounted, are provided such that hinge mounting pins 28*a*, 29*a*, 28*b* and 29*b* extend from mounting pans 26*a* and 26*b* to accept a portion of a hinge. Alternatively, if the exterior wall 22 is thick enough, instead of pins 28*a* and 29*a*, receptacles, such as threaded receptacles, or other mounting devices may be provided. When pins 28*a* and 29*a* are used, in some embodiments they may be threaded as bolts to accept a nut. Each door may have one hinge mounting area 26*a* although preferably they include at least two hinge mounting areas 26*a* and 26*b*, each of which contain mounting pins 28*a*-29*a* and 28*a*-29*b* or another mounting mechanism to accept a portion of a hinge.

Wall 35 of storage compartment 30 also contains hinge pins 36*a* and 38*a* or other mounting devices at one or more positions designed to correspond to the position of door hinge mounting pan 26*a* when door 16 is mounted onto storage compartment 30. Similarly, where second hinge mounting area 26*b* is used, additional mounting pins 36*b* and 38*b* are provided. Pins 36*a*/36*b* and 38*a*/38*b* may be threaded, unthreaded or they may not be pins at all and instead may be receptacles or other devices onto which the hinge member may be mounted.

Mounting pins in the hinge pans may receive a mounting member and secure the mounting member to the door or wall, as applicable. The securing provided by the pins may be total, or it may be partial and the mounting members may also have additional support or connection such as by a weld, slot, overlapping member or other connecting means.

Door 16 is sized to fit over storage compartment access opening 32. Optionally, some or all of door 16 may be equipped with a gasket 23 or one or more other devices made of metal, foam or other materials designed to help prevent moisture from entering storage compartment 30 when door 16 is closed. Thus, the door 16 may be slightly larger than the compartment opening 32 so that the outer layer 22 of door 16 overlaps some of the vehicle body, and gasket 23 helps to prevent moisture from entering compartment 30 when door 16 is closed.

Figure 3:
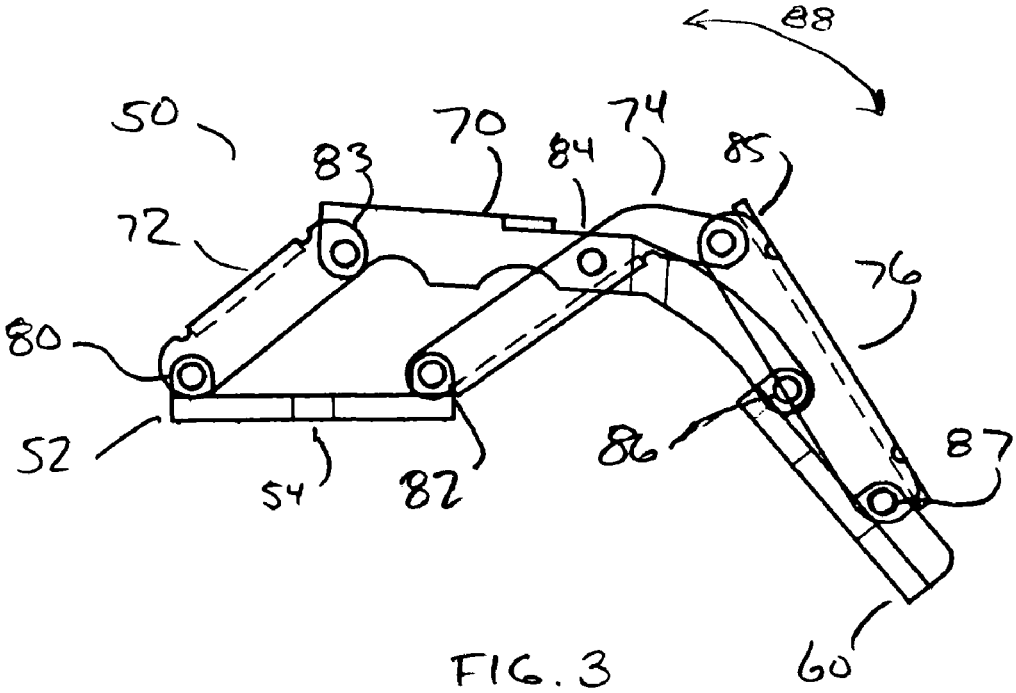
FIG. 3 is an illustration of an exemplary hinge in an open position.
Figure 4:
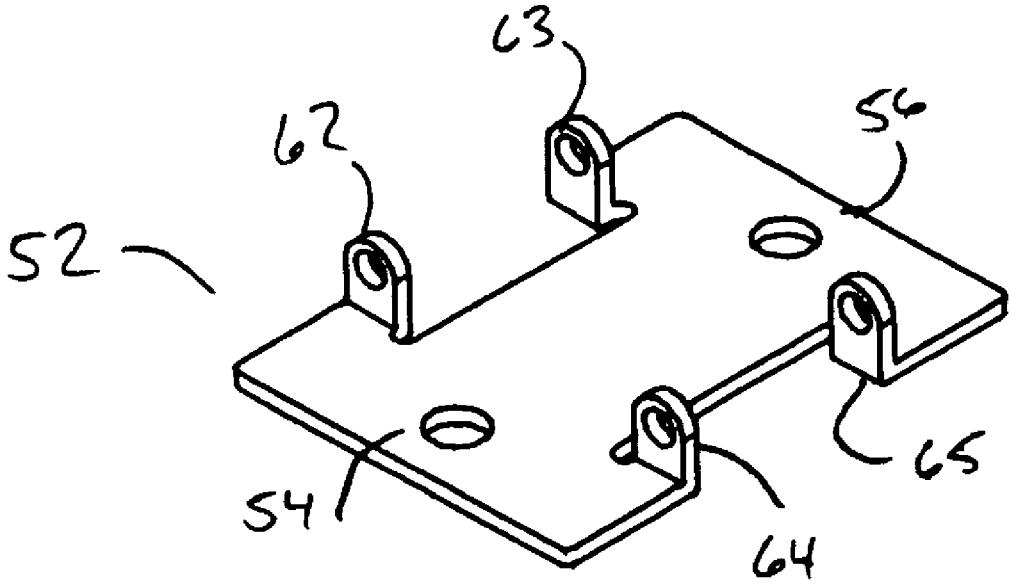
FIG. 4 is a perspective view of an exemplary hinge mounting plate.
Figure 6:
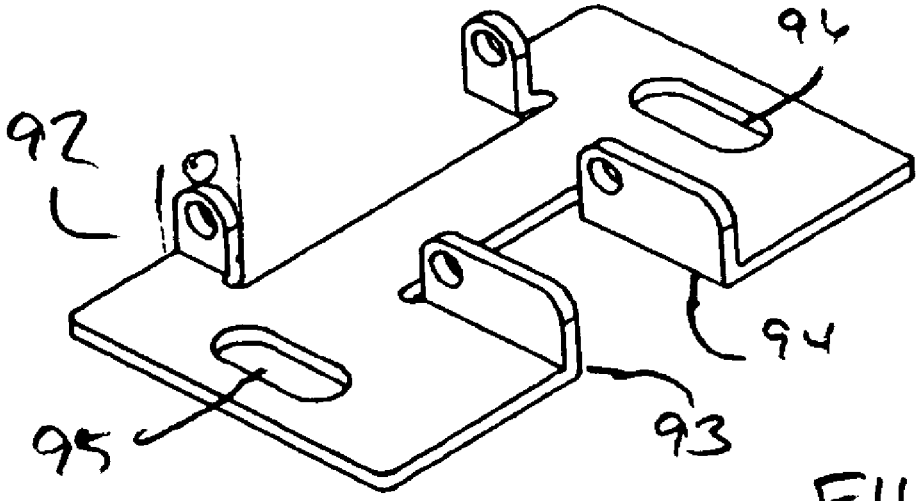
FIG. 6 illustrates an alternate embodiment of a hinge mounting plate.

Referring to FIG. 3, a hinge 50 is illustrated. Hinge includes a first mounting member 52 that includes one or more openings 54 that accept a stud, bolt or other mounting device. As illustrated in FIG. 4, mounting member 52 may be a planar surface that has openings 54 and 56 that are circular to accept a stud at a precise position. Alternatively, the openings 54 and 56 may be of other shapes, such as an oval shape or a "cross" or "plus sign" so that the hinge may be slightly moved in one or more directions as may be required for mounting in a particular application. An example of such an embodiment is shown in FIG. 6, where mounting bracket 92 has oval-shaped openings 95 and 96, and elongated axial members 93 and 94.

Returning to FIG. 4, axis members 62, 63, 64 and 65 extend or protrude from plate 52 in a substantially perpendicular manner and contain openings to which another member may be secured. Axis members may be provided as shown with four separate members 62, 63, 64 and 65. Alternatively, two axis members (such as 62 and 63 or 64 and 65) may be provided as a single elongated member with two openings on a single axis member. The location of the axis members may vary depending on the desired application. For example, axis members 64 and 65 may be located closer to the center of mounting member 52, or in another location. Mounting member 52 may be manufactured as a single piece, and axis members 62, 63, 64 and 65 may be raised from plate 54 by a bending force during manufacture so that they are positioned to be substantially perpendicular to a planar surface of the mounting plate. Other manufacturing methods, such as molding, welding, or other methods, are possible.

Referring again to FIG. 3, first mounting member 52 may be interconnected with a second mounting member 60 such that the first mounting member 52 may be attached to a door and the second mounting member 60 attached to a wall, or vice versa. First mounting member 52 may be interconnected with second mounting member 60 by a series of interconnected radial members. First radial member 70 is connected to second mounting member 60 by one or more pins 86. A "pin" may include, for example, a rivet, a stud, a cotter pin, or any other item that pivotably secures the pieces together. First radial member 70 is attached to first extension 72 by one or more pins 83, and first extension 72 is connected to first mounting member 52 by one or more pins 80. Thus, first radial member 70 and first extension member 72 provide a connection from first mounting member 52 to second mounting member 60 that may swivel at pins 80, 83 and 86 to open or close a door. Each radial member and connection member may be considered to be a connecting member that pivotally connects the mounting members.

Similarly, first mounting member 52 and second mounting member 60 are also connected by second radial member 74 and second extension member 76 to provide a continuous structure that swivels at pins 82, 85 and 87. Finally, pin 84 pivotally connects first radial member 70 with second radial member 74 at an axial position.

Figure 7:
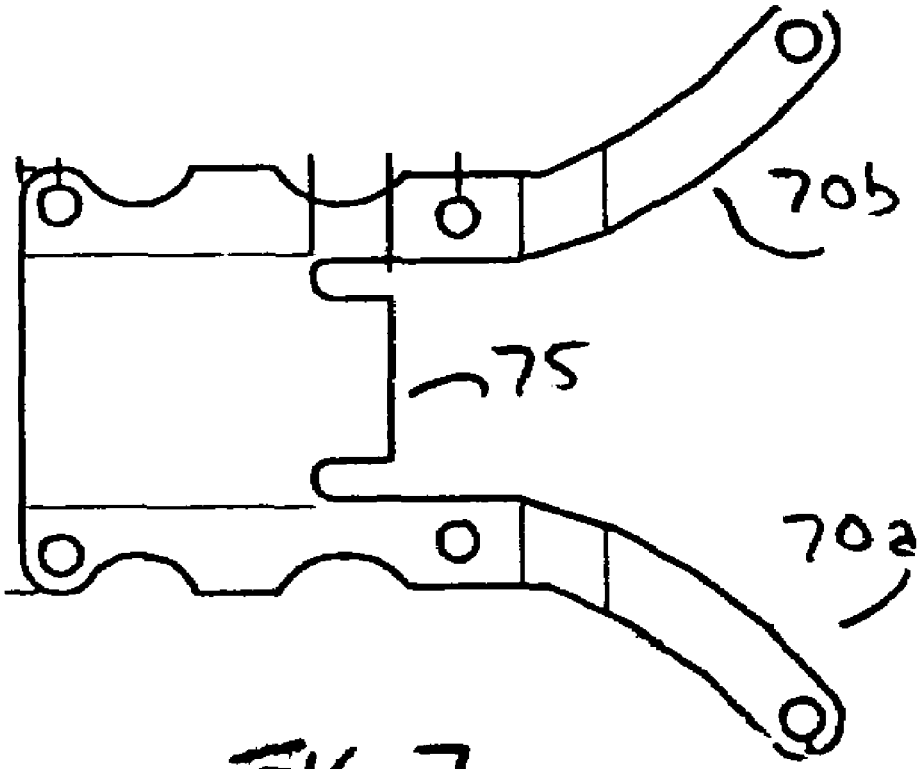
FIG. 7 illustrates an exemplary radial member pair with joining member.

Radial members 70 and 74 may be provided in pairs so that a radial member attaches to opposing axial members (for example, opposing axial members such as 62 and 63 in FIG. 4). Such radial member pairs may be separate members in some embodiments. To provide additional support, as illustrated in FIG. 7 radial member pair 70*a* and 70*b* may be joined by or integrally formed with one or more interconnecting or joining members 75. Such a joining member 75 may also provide for easier manufacture, as radial member pair 70*a* and 70*b* may be formed with joining member 75 so that radial member pair 70*a* and 70*b* may be bent at an approximately ninety degree angle with respect to joining member 75.

Figure 5:
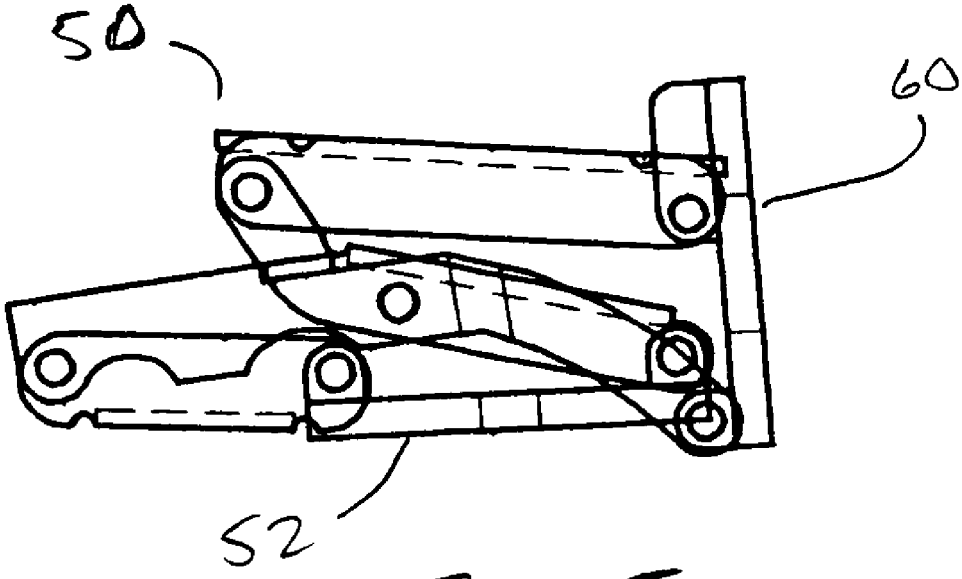
FIG. 5 illustrates a hinge in a closed position.

Returning to FIG. 3, a hinge 50 is illustrated in an open position. Optionally, the opening permits substantial rotation of the door, such as to an angle 88 of at least 160°, such as about 170°, or about 180°. FIG. 5 illustrates hinge 50 in a closed position so that the angle of the door mount with respect to the cabinet mount is approximately 90°. Thus, referring to FIG. 5, in operation first mounting member 52 may be attached to the wall of a storage compartment, while second mounting member 60 may be attached to a door. When hinge 50 is opened as shown in FIG. 3, the door will be rotated and lifted away from the frame of the storage compartment and thus, in various embodiments, may not scratch or damage the vehicle body during opening or closing, even though the door may overlap the vehicle body.

As illustrated in FIGS. 3 and 5, when the hinge is made of a material sufficient to hold the required load, and where the pins are sufficiently sturdy, such as metal studs or pins having a head at one end, and wherein the other end is welded to the outer side of an axial member, radial member or extension member, the hinge may support a load and permit opening and closing without requiring a spring or other support. However, in alternate embodiments one or more springs may be used. In addition, as shown in FIGS. 3 and 5, the radial members and/or transition members may have one or more cut-outs, notches or curves in such locations as may be required as to avoid interference with the pins and other parts.

In some embodiments, pins may include heads that may be welded or otherwise attached to the applicable members. Alternatively, rivets with peen or thrush washers or caps may be provided, or axles with pinched edges, or other pivotal members may be provided.

Materials for the hinge may include stainless steel, stamped steel, zinc-coated steel, zinc die-cast materials or other materials. Preferably, the hinge and the-pins are made of a high wear material, such as a high-strength, wear-resistant steel.

In various embodiments, to support heavy loads associated with vehicle doors, the working load of the hinge should be at least about 100 pounds, or in some embodiments between about 90 pounds and about 200 pounds. Also preferably, hinges are not equipped with springs, other latches or other wear-related items to reduce maintenance and replacement requirements. To provide such load bearing ability, the thickness of the mounting members, radial members and extension members may be, for example, that of 10-gage or 12-gage steel or other metal. Other sizes, such as that of 8-gage steel or 14-gage steel or thicker, or other sized metal, may be provided.

Mounting members 52 and 60 may be mounted to hinge pans (such as 26*a* and the area associated with pins 36*a* and 38*a* shown in FIG. 2) by bolting and/or welding, such as spot welds, overlapping spot welds, bolting, or other means to provide secure mounting of the hinge.

Thus, a door, such as a truck body door or a door for another vehicle compartment, may be equipped with one or more hinges such as those described above. A vehicle equipped with such a door and hinge may have a body surface that is uninterrupted by protruding hinges, and compartments that may be accessed by an opening that is substantially the size of the door that covers the opening. Preferably, the door is slightly larger than the opening, such as approximately one to two inches larger than the opening, to provide a moisture-resistant cover.

It is to be understood that the invention is not limited in its application to the details of construction and to the arrangements of the components set forth in this description or illustrated in the drawings. The invention is capable of other embodiments and of being practiced and carried out in various ways. Hence, it is to be understood that the phraseology and terminology employed herein are for the purpose of description and should not be regarded as limiting.

As such, those skilled in the art will appreciate that the conception upon which this disclosure is based may readily be utilized as a basis for the designing of other structures, methods, and systems for carrying out the several purposes of the present invention. It is important, therefore, that the embodiments described herein be regarded as including such equivalent constructions insofar as they do not depart from the spirit and scope of the present invention.

What is claimed is:

1. A vehicle body door hinge, comprising:

a first mounting member;

a second mounting member movable between a first position and a second position relative to the first mounting member, wherein the first position is oriented about 90 degrees relative to the first mounting member, and wherein the second position is oriented about 180 degrees relative to the first position;

a first connecting member that is pivotably connected to the first mounting member, wherein the first connecting member comprises:

a first extension member pivotably connected to first and second portions of the first mounting member; and a first radial member pivotably connected to first and second portions of the first extension member and to first and second portions of the second mounting member, wherein the first radial member comprises:

a first arc-shaped portion which is outwardly curved relative to the first mounting member and is connected to the first portion of the second mounting member; and a second arc-shaped portion which is outwardly curved relative to the first mounting member and is connected to the second portion of the second mounting member; and a second connecting member that is pivotably connected to the second mounting member, wherein the second connecting member comprises:

a second extension member pivotably connected to third and fourth portions of the second mounting member; and a second radial member pivotably connected to first and second portions of the second extension member and to third and fourth portions of the first mounting member;

wherein the first radial member is pivotally connected to first and second portions of the second radial member.

2. The hinge of claim 1, wherein the first mounting member comprises a planar surface having at least two axial members that protrude from the planar surface and connect with the first connecting member.

3. The hinge of claim 1, wherein each connecting member comprises:

a pair of radial members joined by an interconnecting member; and a pair of extension members;

wherein each extension member is joined to a radial member at an axial position.

4. The hinge of claim 1, wherein each mounting member includes at least one opening sized to accept a hinge pan mounting pin.

5. The hinge of claim 1 wherein each mounting member is pivotably connected to a connecting member by a pin.

6. The hinge of claim 1, wherein the hinge has a working load bearing rating of at least 90 pounds.

7. The hinge of claim 1 wherein the hinge does not require an attached spring for operation.

8. A truck body door hinge, comprising:

a first mounting member comprising a first planar surface, and a first axial member and a second axial member that protrude from the first planar surface;

a second mounting member comprising a second planar surface, and a third axial member and a fourth axial member that protrude from the second planar surface, the second mounting member movable between a first position and a second position relative to the first mounting member, wherein the first position is oriented about 90 degrees relative to the first mounting member, and wherein the second position is oriented about 180 degrees relative to the first position;

a first connecting member that is pivotably connected to the first mounting member, wherein the first connecting member comprises:

a first extension member pivotably connected to first and second portions of the first mounting member; and a first radial member pivotably connected to first and second portions of the first extension member and to first and second portions of the second mounting member, wherein the first radial member comprises:

a first arc-shaped portion which is outwardly curved relative to the first mounting member and is connected to the first portion of the second mounting member; and a second arc-shaped portion which is outwardly curved relative to the first mounting member and is connected to the second portion of the second mounting member; and a second connecting member that is pivotably connected to the second mounting member, wherein the second connecting member comprises:

a second extension member pivotably connected to third and fourth portions of the second mounting member; and a second radial member pivotably connected to first and second portions of the second extension member and to third and fourth portions of the first mounting member;

wherein the first radial member is pivotably connected to first and second portions of the second connecting member.

9. The hinge of claim 8, wherein the hinge does not require an attached spring for operation.

10. The hinge of claim 8, wherein each mounting member includes at least one opening sized to accept a hinge pan mounting pin.

11. The hinge of claim 8, wherein each mounting member is pivotably connected to a connecting member by a pin.

12. The hinge of claim 8, wherein the hinge has a working load bearing rating of at least 90 pounds.

13. A truck body comprising:

a storage compartment having an opening;

a door sized to cover the opening;

wherein the door includes a recessed hinge pan sized and positioned to accept a hinge;

wherein the hinge comprises:

a first mounting member attached to the storage compartment;

a second mounting member attached to the door at the recessed hinge pan, the second mounting member movable between a first position and a second position relative to the first mounting member, wherein the first position is oriented about 90 degrees relative to the first mounting member, and wherein the second position is oriented about 180 degrees relative to the first position;

a first connecting member that is pivotably connected to the first mounting member, wherein the first connecting member comprises:

a first extension member pivotably connected to first and second portions of the first mounting member; and a first radial member pivotably connected to first and second portions of the first extension member and to first and second portions of the second mounting member, wherein the first radial member comprises:

a first arc-shaped portion which is outwardly curved relative to the first mounting member and is connected to the first portion of the second mounting member; and a second arc-shaped portion which is outwardly curved relative to the first mounting member and is connected to the second portion of the second mounting member; and a second connecting member that is pivotably connected to the second mounting members wherein the second connecting member comprises:

a second extension member pivotably connected to third and fourth portions of the second mounting member; and a second radial member pivotably connected to first and second portions of the second extension member and to third and fourth portions of the first mounting member;

wherein the first radial member is pivotably connected to first and second portions of the second connecting member.

14. The body of claim 13, wherein each mounting member includes at least one opening sized to accept a pin that at least partially secures the mounting member to the door at the hinge pan.

15. The body of claim 13, wherein the door is sized to be larger than the opening, and the hinge lifts and rotates the door away from the storage compartment when the door is opened.

* * * * *